US009516954B2

(12) United States Patent
Bilinski et al.

(10) Patent No.: US 9,516,954 B2
(45) Date of Patent: Dec. 13, 2016

(54) SHOWCASE MEMBER WITH DIRECT-MOUNTED LED LIGHT SOURCE

(71) Applicant: GE LIGHTING SOLUTIONS, LLC, East Cleveland, OH (US)

(72) Inventors: Michael James Bilinski, Lyndhurst, OH (US); Robert J. Brassell, East Cleveland, OH (US); Paul M. Kuester, Shaker Heights, OH (US); Kyle Douglas Mooney, Cleveland, OH (US); Jeffrey Marc Nall, Brecksville, OH (US)

(73) Assignee: GE Lighting Solutions, LLC, East Cleveland, OH (US)

( * ) Notice: Subject to any disclaimer, the term of this patent is extended or adjusted under 35 U.S.C. 154(b) by 192 days.

(21) Appl. No.: 14/483,129

(22) Filed: Sep. 10, 2014

(65) Prior Publication Data

US 2015/0070879 A1 Mar. 12, 2015

Related U.S. Application Data

(60) Provisional application No. 61/876,533, filed on Sep. 11, 2013.

(51) Int. Cl.
*A47F 3/00* (2006.01)
*F21K 9/20* (2016.01)
(Continued)

(52) U.S. Cl.
CPC ..... *A47F 3/001* (2013.01); *A47F 11/10* (2013.01); *F21K 9/20* (2016.08); *F21Y 2101/00* (2013.01)

(58) Field of Classification Search
CPC ..... F21K 9/30; F21K 9/20; F21K 9/00; F21K 99/00; F21S 2/00; F21V 9/042; F21V 9/045; A47F 3/001
See application file for complete search history.

(56) References Cited

U.S. PATENT DOCUMENTS 8,119,427 B1 * 2/2012 Lu ..... H01L 33/44 257/E21.514
2007/0195535 A1 8/2007 Artwohl et al.
(Continued)

FOREIGN PATENT DOCUMENTS

JP 2009116418 A 5/2009
JP 2009125310 A 6/2009
(Continued)

OTHER PUBLICATIONS

International Search Report and Written Opinion issued in connection with corresponding WO Application No. PCT/US2014/055247 dated Dec. 22, 2014.

*Primary Examiner* — Anne Hines
(74) *Attorney, Agent, or Firm* — GE Global Patent Operation; Peter T. DiMauro

(57) ABSTRACT

A showcase member of a glass showcase, the showcase member including a first portion having a plurality of apertures, a light emitting diode (LED) module positioned at one or more of the plurality of apertures and mounted to the showcase member, and a wiring harness electrically connected to the LED module, and configured to electrically connect the LED module to an LED driver circuit. The showcase member can include a second portion integral to the first portion and having tapers forming light shields protruding from the showcase member.

17 Claims, 5 Drawing Sheets

(51) Int. Cl.
*A47F 11/10* (2006.01)
*F21Y 101/00* (2016.01)

(56) References Cited

U.S. PATENT DOCUMENTS

| | | | | |
|---|---|---|---|---|
| 2008/0158858 | A1 | 7/2008 | Madireddi et al. | |
| 2011/0051401 | A1 | 3/2011 | Bauer et al. | |
| 2011/0058357 | A1 | 3/2011 | Anderson | |
| 2011/0185609 | A1* | 8/2011 | Miedema | F21S 2/005 40/559 |
| 2012/0087118 | A1* | 4/2012 | Bailey | F21V 29/75 362/235 |

FOREIGN PATENT DOCUMENTS

| | | | |
|---|---|---|---|
| JP | 2010170847 | A | 8/2010 |
| JP | 2010213923 | A | 9/2010 |
| WO | 2007043034 | A2 | 4/2007 |

* cited by examiner

SHOWCASE MEMBER WITH DIRECT-MOUNTED LED LIGHT SOURCE

CLAIM OF PRIORITY

This patent application claims the benefit of priority, under 35 U.S.C. §119(e), of U.S. Provisional Patent Application Ser. No. 61/876,533, filed Sep. 11, 2013, titled "DIRECT MOUNTED LED LIGHT SOURCE" the entire disclosure of which is incorporated herein by reference.

BACKGROUND

To enhance the visual appeal of products displayed in glass showcases, including refrigerated display cases, light sources are added to one or more of the showcase's mullions. In some implementations, a light bar can include a fluorescent fixture holding a fluorescent tube. The light bar is mounted along the face of a mullion inside the showcase. Other implementations mount a light emitting diode (LED) light bar on the mullion(s).

FIG. 1A is a perspective view of a conventional light bar 100. Light bar 100 includes lens 110 and housing 120. A light source is located within the light bar (e.g., fluorescent lamp(s) or LED light modules). FIG. 1B is a perspective view of a typical mounting arrangement for light bar 100 having LED modules inside the light bar. The light bar is mounted to mullion 130 by first attaching mounting clips 140 spaced along the surface of the mullion. These mounting clips have protrusions which snap into extruded grooves on the external surface of light bar 100. Electrical connection is made to the light sources by attaching power leads 150 from the light bar to power supply wires 152 located within mullion 130 then, optionally, pieces can be added as finishing trim.

DESCRIPTION

Figure 1A:
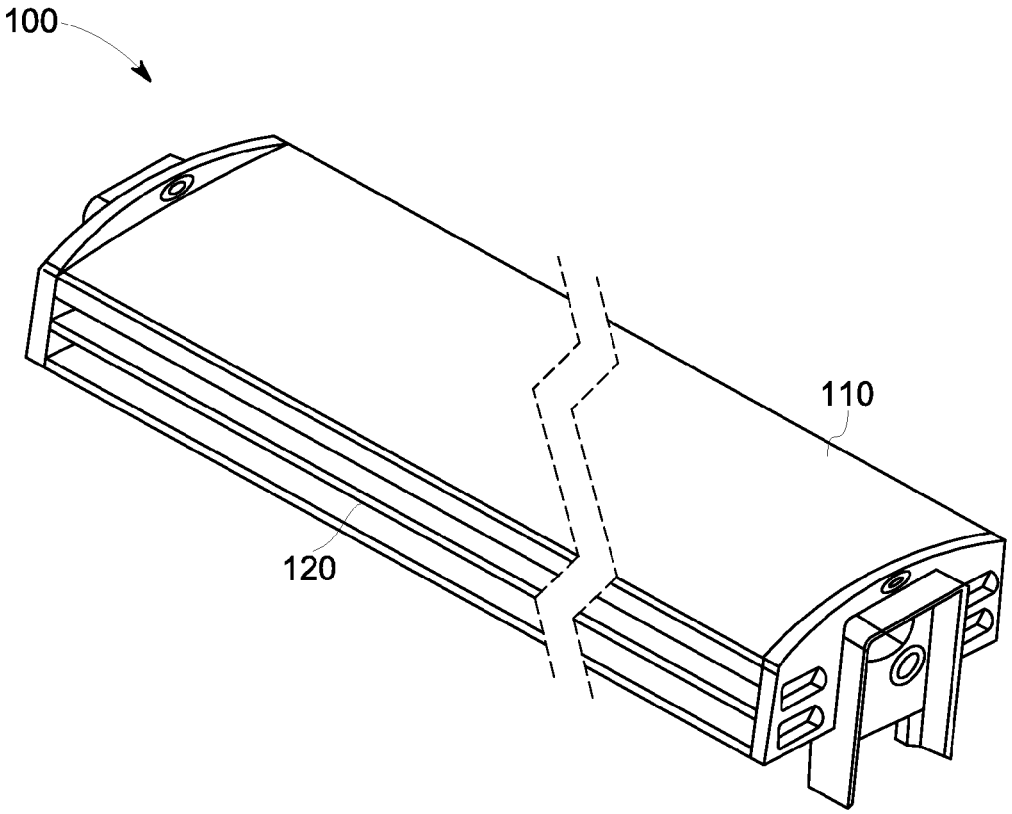
PRIOR ART FIG. 1A
FIG. 1A is a perspective view of a conventional light bar.
Figure 1B:
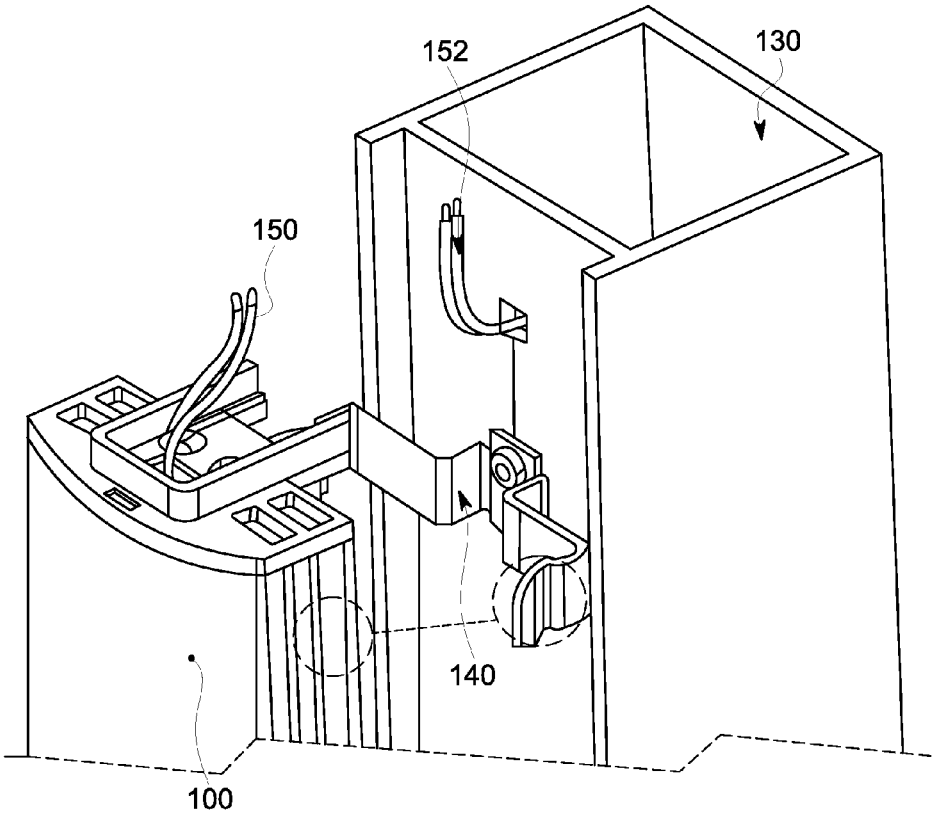
PRIOR ART FIG. 1B
FIG. 1B is a perspective view of a typical mounting arrangement for the conventional light bar of FIG. 1.

In accordance with embodiments, one or more LED modules are mounted directly to a member of a glass showcase. The showcase member can be a mullion, a frame or structural piece, a trim piece, a finishing piece, top, side, and/or bottom plate. The showcase member can be vertically, horizontally, or diagonally orientated. The number of LED modules mounted to the showcase member is dependent on such factors as the length of the showcase member; the LED light intensity; the desired illumination affect; and other factors. When mounted to the showcase member, the LED module and the member form a complete device that can be used in constructing a showcase.

The LED module includes an LED light engine (e.g., a LED chip array, LED wafer, etc.) as a light source, an optical element (e.g., lens, reflector, etc.), and a printed circuit board (PCB). The PCB can include etched circuitry and/or wiring which connects to terminals on the LED light engine. The body of the LED module can be overmolded with a coating (e.g., plasticized) to provide environmental protection and electrical isolation.

Individual LED modules are inserted through, or positioned at, apertures in a first portion of the showcase member surface. A wiring harness can connect the LED modules to an LED driver circuit/power supply. The wiring harness itself can be located within the showcase member and connect to the LED modules' PCB. In another implementation the wiring harness can be located on an external showcase member surface and dressed/concealed with wiremold or some other encasement. In accordance with some embodiments, the wiring harness can be configured to connect the LED modules to a LED driver circuit/power supply by providing an electrical connector that can be connected to the LED driver circuit/power supply at a location remote from the showcase member.

The optical element is positioned over the LED light engine. The optical element directs (e.g., diffracts or otherwise shapes and/or redirects) light emitted by the LED towards the products placed in the showcase to help enhance their appearance and desirability. In accordance with embodiments, the optical element can be a total internal reflection (TIR) lens, a Fresnel lens, a reflector, and/or the like. The optical element can direct the emitted light towards the left and right, typically with less light being directed forward. Because the showcase member may block the product view from outside the showcase, there may be less need for light directly in front of the showcase member.

The LED module may be mounted to the showcase member providing a minimal protrusion above the surface of the showcase member. The combined thickness of the direct mounted LED source in combination with the showcase member may have a thinner profile than conventional light bars in combination with the showcase mullion. Thus, the light source may be further from the displayed product than with a conventional light bar. This added distance may reduce the light beam pattern diffraction angle needed to illuminate the displayed product. Commensurate with the reduced diffraction angle is a more efficient and uniform lighting affect.

Combining the LED module with the showcase member may remove the need of an independent housing which is a necessary part of the prior art light bar. In accordance with embodiments, the LED module can be mounted to the showcase member without a separate housing by several modes. In accordance with implementations shown and described herein are several implementations. However, any number of other configurations may be provided in accordance with embodiments.

Figure 2:
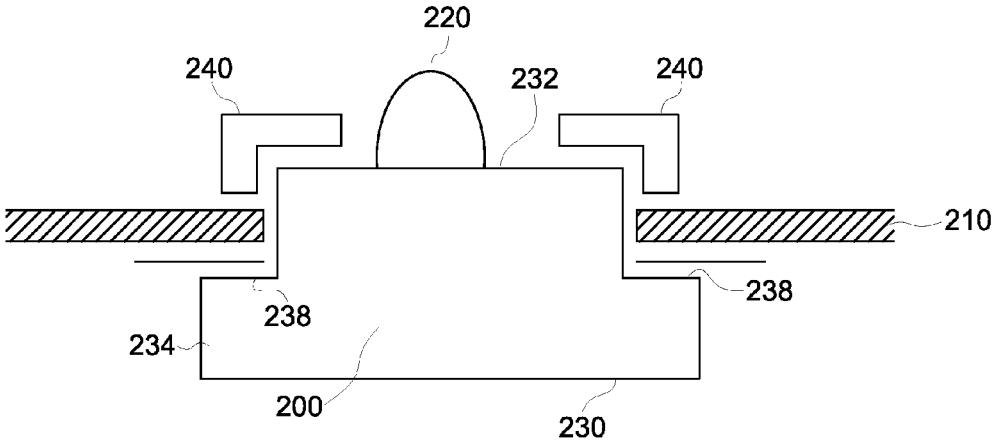
FIG. 2 depicts an LED module mounted in a showcase member in accordance with an embodiment.

FIG. 2 depicts LED module 200 mounted in an aperture formed on showcase member 210 in accordance with an embodiment. The LED module includes optical element 220 and body 230. Body 230 includes first cross-sectional width 232 and second cross-sectional width 234. The second cross-sectional width is wider than the first cross-sectional width. The portion of body 230 where the two cross-sectional widths meet forms seat 238.

The LED module is inserted into the showcase member aperture until seat 238 rests against an underside of the showcase member. Bezel 240 can be inserted between the LED module and the showcase member and pressed-fit against first cross-sectional width 232 to hold the LED module in the aperture.

In one implementation, the bezel can include a recess along its lower leg. This recess can snap-fit into a protrusion on the aperture's edge, or a protrusion located on the LED module. Conversely, the recess can be located on the showcase member or LED module, and the protrusion on the bezel lower leg.

Figure 3:
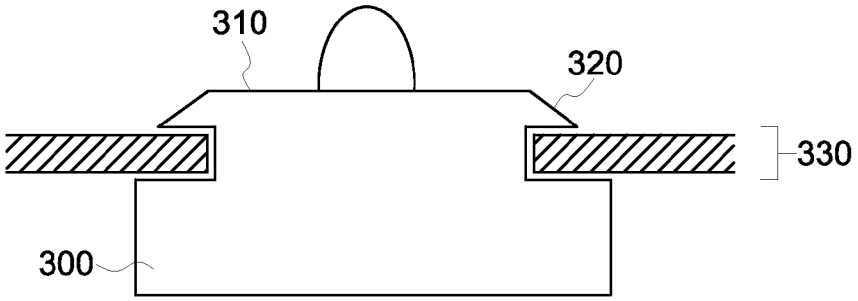
FIG. 3 depicts an LED module mounted in a showcase member in accordance with another embodiment.

FIG. 3 depicts LED module 300 mounted in an aperture formed on showcase member 210 in accordance with an embodiment. In accordance with this implementation, the LED module itself can include snap-fit features, which provide for the LED module to snap into the showcase member aperture.

LED module 300 includes additional material 310 extending from the first cross-sectional width. This extended, additional material forms notch 330 in the profile of the LED module. Insertion of the LED module into the showcase member aperture causes the edge of the showcase member aperture to snap into the notch The outer edge of the additional material can be include taper 320. As the LED module is inserted into the showcase member aperture, the tapered edge can ease the LED module through the aperture and then prevent it from reversing back out of the aperture. In one implementation, at least a portion of the showcase member aperture edge can include a complementary taper. In accordance with implementations, the material used to form at least taper 320 can be pliable so that the LED module can be removed by applying a reverse force.

Figure 4:
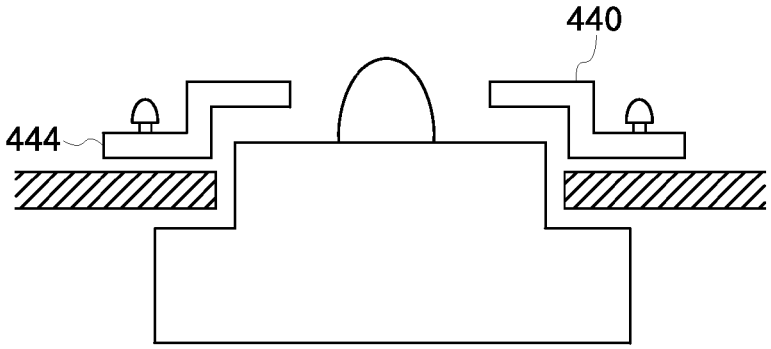
FIG. 4 depicts an LED module mounted in a showcase member in accordance with another embodiment.

FIG. 4 depicts LED module 200 mounted in an aperture formed on showcase member 200 in accordance with an embodiment. In accordance with an embodiment, bezel 440 can be held into place with screws or rivets. The bezel can include flange 444. The flange can include through holes/slots to accept rivets and/or screws. The rivets or screws can secure the bezel to the showcase member so as to provide secure placement of the LED module.

Figure 5:
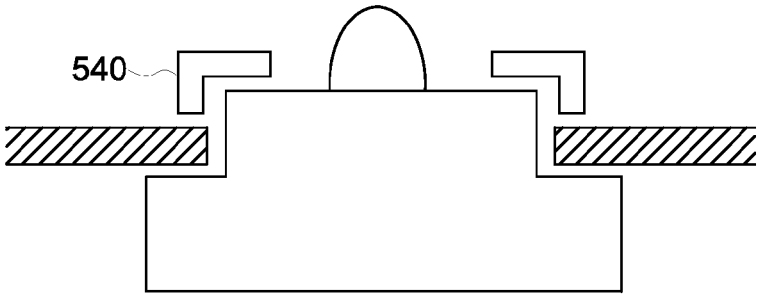
FIG. 5 depicts an LED module mounted in a showcase member in accordance with another embodiment.

FIG. 5 depicts LED module 200 mounted in an aperture formed on showcase member 210 (numbering as in FIG. 2) in accordance with an embodiment. In accordance with an embodiment, bezel 540 can be welded to the showcase member, or ultrasonically welded to the module's overmolding material.

Figure 6:
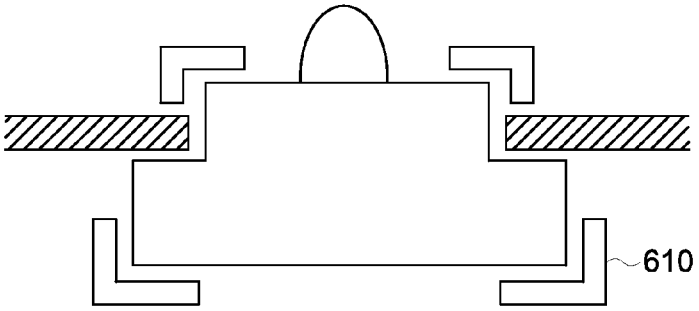
FIG. 6 depicts an LED module mounted in a showcase member in accordance with another embodiment.
Figure 7:
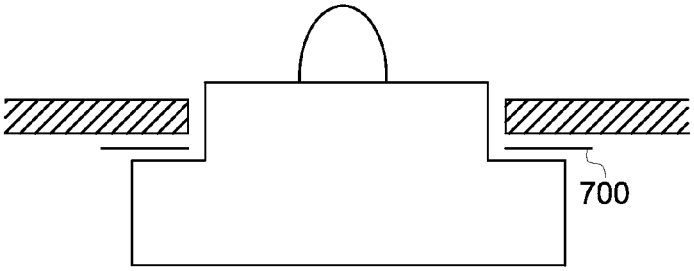
FIG. 7 depicts an LED module mounted in a showcase member in accordance with another embodiment.

FIG. 6 depicts LED module 200 mounted in an aperture formed on showcase member 210 in accordance with an embodiment. In accordance with an embodiment, the bezel can magnetically adhere to the LED module. Impregnating the overmold material with magnetic material before the overmold is formed can result in enough magnetic attraction to hold the bezel in place. This magnetic attraction can secure the LED module in the aperture. In another implementation, opposing magnets 610 can be placed on the underside of the showcase member to hold the bezel in position FIG. 7 depicts LED module 200 mounted in an aperture formed on showcase member 210 in accordance with an embodiment. In accordance with an embodiment, adhesive material 700 (e.g., tape, glue, etc.) can be positioned between an underside of the showcase member and LED module seat 238. In one implementation, the two-sided tape can be die cut to fit around seat 238. In another implementation, an ultra-high bond adhesive can be placed on the seat.

In accordance with embodiments, LED modules can be installed inside of, or on top of, an existing showcase member. Some embodiments pertain to mounting a light engine from the inside of a showcase member. Such mounting can be performed from either the front or the back of the showcase member. Methods of so mounting an LED module to a showcase member can be carried out in any suitable fashion, and encompasses being carried out by the original equipment manufacturer (OEM), and/or carried out as a retrofit of an existing showcase member.

Figure 8:
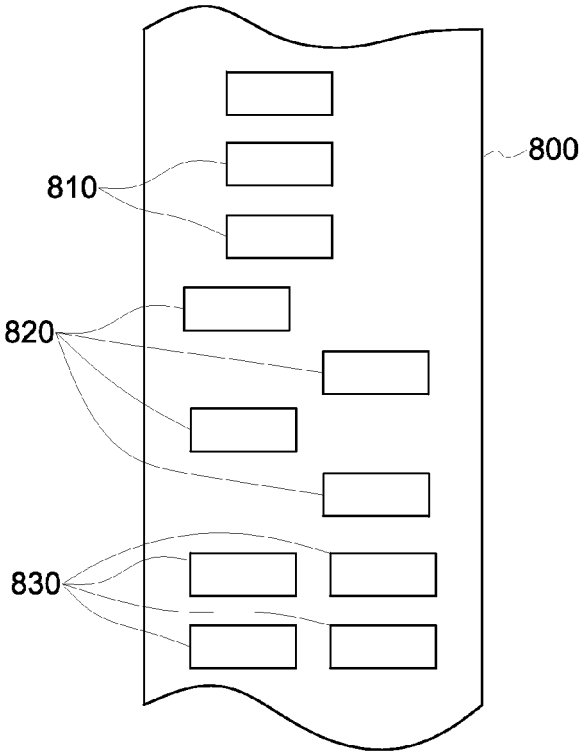
FIG. 8 depicts a showcase member plan view having apertures in accordance with embodiments.

FIG. 8 depicts showcase member 800 having apertures 810, 820, 830 in accordance with embodiments. Apertures can be either equally spaced along the length of the showcase member, or strategically placed at different densities to put more light in areas of the case with different light level needs, such as at the top or bottom of the showcase where there could be deeper shelf areas. The apertures need not be in a single row (e.g., apertures 810), but can be formed as an array of apertures depending on the door, showcase geometry, and/ or lighting requirements (e.g., apertures 820, 830). In some implementations the orientation of the aperture can be rotated up to as much as 90 degrees from the orientation depicted in FIG. 8.

In accordance with embodiments, the showcase member can have one or more apertures along its length in which can be inserted LED modules, rather than a single slot that runs the whole length of a mullion to accept a light bar. Each LED module does not have to be identical. For example, LED modules can have different optical elements, light engines, etc. depending on placement on the showcase member, the member's position in the showcase, and/or the orientation of the LED module on the showcase member.

Figure 9:
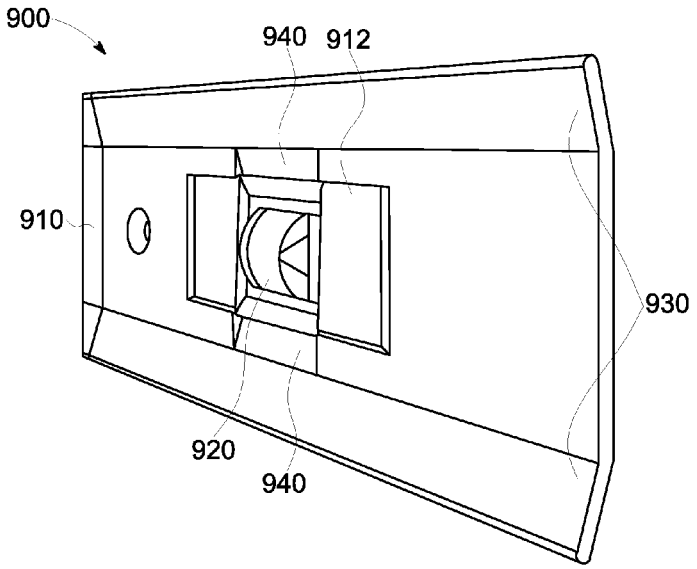
FIG. 9 depicts a perspective view of a portion of a showcase member in accordance with embodiments.

FIG. 9 depicts a perspective view of a portion of showcase member 900 having tapered sections in accordance with embodiments. The showcase member includes a first portion 910 in which aperture 912 is formed to receive an LED module 920 in accordance with embodiments. Side portions 930 of showcase member 900 are bent outward to form light shields. These light shields are angled so that when positioned in the showcase, the light shields reduce the angular propagation of light from the LED modules to reduce glare from the LED modules. This glare can cause a user to avert their eyes, thus limiting the selection of product viewed by the user.

In accordance with another implementation, the LED module can be mounted in recess 940 formed in first portion 910 at the location of aperture 912. Recess 940 can extend across about the width of the first portion adjacent to the aperture. By mounting the LED module in an aperture adjacent to the recesses, the angular glare of the LED module can be reduced. In accordance with some embodiments, showcase member can include side portions 930 and/or recesses 940 to form the light shields to reduce angular glare from the LED modules.

Figure 10:
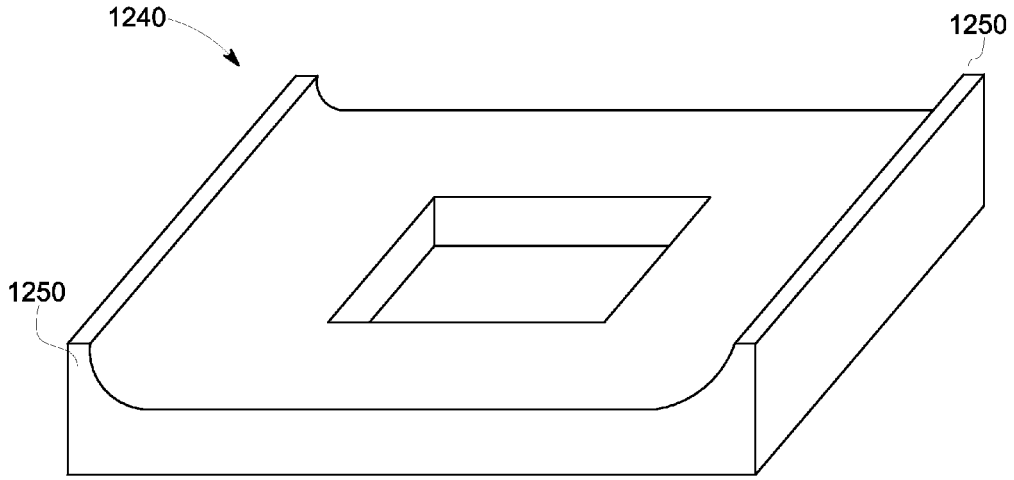
FIG. 10 depicts a perspective view of a bezel in accordance with embodiments.

FIG. 10 depicts a perspective view of bezel 1240 in accordance with some embodiments. Bezel 1240 can be used to hold LED module in an aperture formed in the showcase member as disclosed above with reference to FIG. 2. As disclosed above, an LED module can be seated against an underside of the showcase member. Bezel 1240 can be press-fit between the LED module and the showcase member to secure the LED module to the showcase member. In accordance with an embodiment, Bezel 1240 includes extended side portions 1250 which form light shields. These light shields are angled so that when positioned in the showcase, the light shields reduce the angular propagation of light from the LED modules to reduce glare from the LED modules.

In accordance with embodiments, the apertures can be formed in the showcase member by being punched, stamped, or routed into the showcase member's face using standard machining processes. In some implementations (e.g. retrofit operations) the apertures can be punched in the field using standard hole-punch tools. Depending on the LED module geometry, standard punch-out dies or custom dies can be used to match the module's geometry.

Embodiments of the present disclosure can include the following advantages: lower cost by utilizing standardized LED modules and reduced parts (e.g., mounting clips and associated hardware may be avoided), ease of installation, an improved aesthetic look, and an improved optical performance from having a mounting profile closer to the mullion surface. Embodiments typically do not require an independent housing and result in additional available space for product placement and deeper shelving.

Although specific hardware and methods have been described herein, note that any number of other configurations may be provided in accordance with embodiments of the invention. Thus, while there have been shown, described, and pointed out fundamental novel features, it will be understood that various omissions, substitutions, and changes in the form and details of the illustrated embodiments, and in their operation, may be made by those skilled in the art without departing from the spirit and scope of the invention. Substitutions of elements from one embodiment to another are also fully intended and contemplated.

The invention claimed is:

1. A showcase member of a glass showcase, the showcase member comprising:

a first portion having a plurality of apertures therein, the first portion including two surfaces; and one or more light emitting diode (LED) modules positioned at corresponding one or more of the plurality of apertures and each of the one or more LED modules being mounted to the first portion, wherein a seat of the each LED module is in a touching contact with a first one of the two surfaces of the first portion, the seat being formed by a portion of the each LED module where two cross-sectional widths, a top cross-sectional width of a top portion of the LED module and a wider bottom cross-sectional width of a bottom portion of the LED module, intersects, and wherein the each LED module is held in place using at least said touching contact with the first one of the two surfaces of the first portion.

2. The showcase member of claim 1, further comprising:

at least one bezel, press-fitted at least partially into the corresponding aperture corresponding to the position of the each LED module, the bezel being configured to hold the LED module in position by establishing contacts with a second one of the two surfaces and with the top portion of the LED module.

3. The showcase member of claim 2, wherein the corresponding LED module comprises one of a recess and a protrusion, the recess and protrusion configured to snap-fit into an opposite one of a protrusion and recess located at a corresponding position on the at least one bezel.

4. The showcase member of claim 2, wherein the at least one bezel comprises extended side portions configured to form light shields.

5. The showcase member of claim 1, wherein the each LED module comprises an optical element configured to direct emitted light outward from the LED module in a pattern to illuminate a product within an interior of a showcase.

6. The showcase member of claim 1, wherein the each LED module comprises an overmolding coating on a body of the each LED module.

7. The showcase member of claim 6, wherein the overmolding coating impregnated with magnetic material, and the body of the each LED module is mounted by magnetic attraction.

8. The showcase member of claim 7, wherein the magnetic attraction is between the impregnated overmolding and a bezel positioned at least partially into the aperture corresponding to the position of the each LED module.

9. The showcase member of claim 1, wherein the plurality of apertures are positioned on the first portion at different densities so as to provide LED module lighting of differing intensities along the length of the showcase member.

10. The showcase member of claim 1, further comprising a second portion integral with the first portion, and positioned to a side of the first portion;

the second portion including tapers configured to form a light shield protruding from the second portion.

11. The showcase member of claim 1, wherein the first portion comprises at least one recess transverse to the first portion and located at a position of at least one of the plurality of apertures, wherein the at least one recess forms a light shield.

12. The showcase member of claim 1, wherein the each LED module is further held in place using a direct or indirect contact between a second one of the two surfaces of the first portion with the top portion of the each LED module.

13. The showcase member of claim 1, wherein the top portion of the each LED module comprises a rectangular-shaped cut above the seat with an additional material of the each LED module above the cut being flexible, so that when the each LED module is inserted into the corresponding aperture of the first portion, an edge of the flexible additional material snaps into the rectangular-shaped cut to provide a direct contact of the top portion of the each LED module with a second one of the two surfaces of the first portion in order to hold the each LED module in place.

14. The showcase member of claim 13, wherein the edge of the additional flexible material of the each LED module above the cut is pliable, so that the each LED module can be removed by applying a reverse force to said edge.

15. The showcase member of claim 1, further comprising a wiring harness electrically connected to the each LED module, and configured to electrically connect the each LED module to an LED driver circuit/power supply.

16. The showcase member of claim 1, wherein said touching contact is secured by using an adhesive or a double tape.

17. A member of an apparatus comprising:

a first portion having a plurality of apertures therein, the first portion including two surfaces; and one or more light emitting diode (LED) modules positioned at corresponding one or more of the plurality of apertures and each of the one or more LED modules being mounted to the first portion, wherein a seat of the each LED module is in a touching contact with a first one of the two surfaces of the first portion, the seat being formed by a portion of the each LED module where two cross-sectional widths, a top cross-sectional width of a top portion of the LED module and a wider bottom cross-sectional width of a bottom portion of the LED module, intersects, and wherein the each LED module is held in place using at least said touching contact with the first one of the two surfaces of the first portion.

* * * * *